United States Patent [19]

Cloutier

[11] Patent Number: 4,595,890

[45] Date of Patent: Jun. 17, 1986

[54] DUAL POLARIZATION TRANSITION AND/OR SWITCH

[75] Inventor: Donald C. Cloutier, Exeter, N.H.

[73] Assignee: Omni Spectra, Inc., Merrimack, N.H.

[21] Appl. No.: 391,968

[22] Filed: Jun. 24, 1982

[51] Int. Cl.[4] ..... H01P 1/15; H01P 1/161; H01P 5/12

[52] U.S. Cl. ..... 333/103; 333/125; 333/21 R; 333/21 A; 343/786

[58] Field of Search ..... 333/101, 103, 136, 21 R, 333/21 A, 26, 125

[56] References Cited

U.S. PATENT DOCUMENTS

| | | | |
|---|---|---|---|
| 2,556,377 | 6/1951 | Robertson | 333/21 A X |
| 3,919,670 | 11/1975 | Klein | 333/21 A X |
| 4,020,431 | 4/1977 | Saunders | 333/21 R X |

FOREIGN PATENT DOCUMENTS

| | | | |
|---|---|---|---|
| 83101 | 7/1981 | Japan | 333/21 A |

*Primary Examiner*—Paul L. Gensler

*Attorney, Agent, or Firm*—Wolf, Greenfield & Sacks

[57] ABSTRACT

A circular waveguide dual antenna feed for TVRO reception, which transfers horizontally and vertically polarized received signals in the circular waveguide simultaneously into two coaxial lines parallel with and offset from the circular waveguide axis. For coupling to existing LNA's, the separate coaxial lines from the circular waveguide are extended into a rectangular waveguide which couples to the input-mixer of the conventional LNA. Alternatively, the separate coaxial lines can be coupled separately to two LNA's or they can be combined into a single output terminal. Switching means are provided in each channel so that each channel can be rendered operative or inoperative, as desired. Diode switches are shown. The device requires no moving parts.

18 Claims, 10 Drawing Figures

DUAL POLARIZATION TRANSITION AND/OR SWITCH

BACKGROUND OF THE INVENTION

The invention is applicable to communication systems, wherein a plurality of frequency channels are closely spaced and/or slightly overlapped. This is done in order to increase the number of channels within a given frequency range. In satellite communications and particularly in television receive only (TVRO) satellite communications isolation between channels is provided by changing from horizontal polarization to vertical polarization or vice versa between each pair of adjacent channels. Therefore, it is necessary to switch from horizontal polarization to vertical polarization or vice versa between adjacent channels at the transmitting and receiving antennas.

PRIOR ART

At the present time, TVRO antennas are switched between horizontal and vertical polarization by physically rotating the antenna feed back and forth through a ninety degree range by means of a motor mechanism. Motor mechanisms are undesirable for many reasons. They are slow acting, bulky, expensive, and they are subject to failure due to use of many mechanical moving parts. Ferrite devices known as Faraday rotators are also in use, being attractive because they have no moving parts. However, the Faraday rotator devices are bulky, expensive, and have other characteristics which make them undesirable. For example, they are temperature sensitive, frequency sensitive, and require large electric currents to operate them. The temperature and frequency sensitivity necessitates adjustment of the electric current for optimum performance (tweeking) whenever the temperature changes and each time channel selection is changed.

In the art of TVRO reception, a low noise amplifier (LNA) is mounted behind the antenna feed. To maintain antenna efficiency, it is desirable to keep the antenna feed, the polarization switch, and the LNA as small as possible and mounted in line on or near the antenna axis.

A GENERAL DESCRIPTION OF THE INVENTION

The invention makes use of dual end-launcher coaxial line to circular waveguide transitions and dual end-launcher coaxial line to rectangular waveguide transitions. In each case, the transition uses axially-offset loop coupling to prevent interaction between the coupling loops. The circular waveguide transitions also use radial probe coupling. The rectangular waveguide transitions also use probe coupling perpendicular to the waveguide axis and at an angle of approximately 45° with the waveguide walls. Prior art end-launcher transitions in both rectangular and circular waveguide are all single transitions and use axial loop coupling and axial probe coupling. The prior disclosures of interest are set forth in Procedures of the IEEE, Volume 123, No. 10, October 1976, entitled, "Coaxial-to-Waveguide Transition (end-launcher type)" by B. N. Das and G. S. Sanyal, and in the IEEE Transactions on Microwave Theory and Techniques, September 1978, Vol. MTT-26, No. 9, entitled, "Analysis of an End-Launcher for a Circular Cylindrical Waveguide" by M. D. Deshponde and B. N. Das.

The invention provides a unique dual antenna feed in circular waveguide which transfers horizontally and vertically polarized signals in the circular waveguide simultaneously into two coaxial lines parallel with and offset from the circular waveguide axis.

In a preferred embodiment of the invention, shown in FIG. 1, the separate coaxial lines from the circular waveguide are extended into a rectangular waveguide which couples to the input-mixer of the conventional LNA. The rectangular waveguide network is a dual transition from the two coaxial lines where one responds only to the horizontally polarized receive signals, while the other responds only to the vertically polarized signals. Switching means are provided in each of the channels so that one channel or the other can be rendered operative or inoperative as desired. These switch means can be solid state, or mechanical switches suitable for use at the radio frequencies employed.

An alternative embodiment of the invention is shown in FIG. 9. In this case, the coaxial lines from the circular waveguide are connected to a stripline or microstrip circuit board. The circuit board in this illustrated example contains a single pole-double-throw diode switch to connect a single output coaxial line with either the horizontal or vertical input signal.

The two coaxial lines from the circular waveguide can be used to feed two LNAs directly without switching. In that case, one LNA will respond to horizontally polarized signals and the other to vertically polarized signals.

DETAILED DESCRIPTION OF THE DRAWINGS

Figure 1:
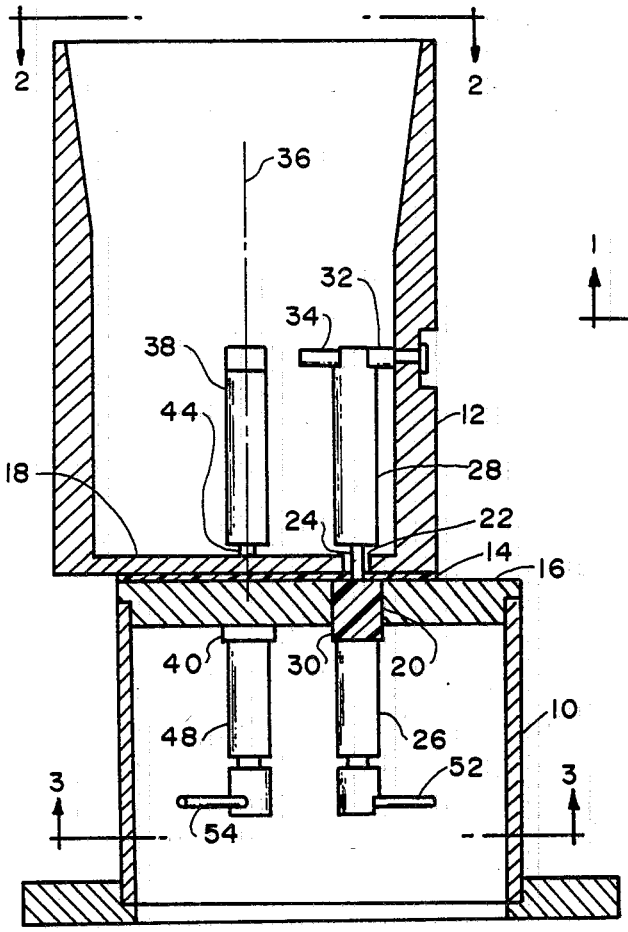
FIG. 1 is a longitudinal section through a dual mode switchable network according to the invention.
Figure 2:
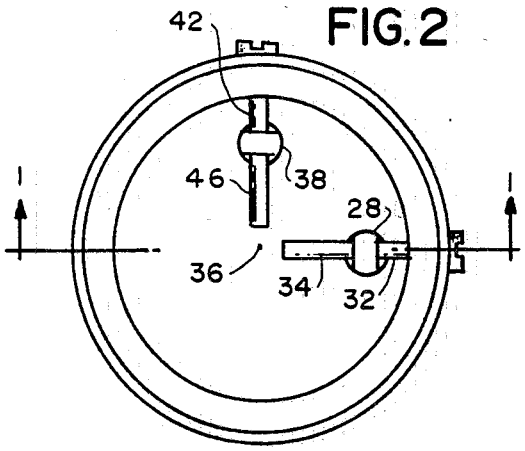
FIG. 2 is a transverse section taken on line 2—2 of FIG. 1.
Figure 3:
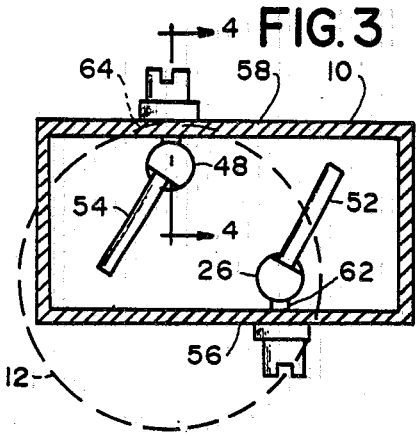
FIG. 3 is a transverse section taken on line 3—3 of FIG. 1.

Referring to FIGS. 1, 2 and 3, a section of rectangular waveguide 10 is connected endwise to a section of circular waveguide 12, a shim of dielectric material 14 being between them. As will presently be explained, it is desirable that the rectangular waveguide section 10 and the round waveguide section 12 be electrically insulated from each other with respect to direct current and to maintain this D.C. isolation these two sections of waveguide may be joined together with dielectric screws (not shown), for example, Nylon screws. The rectangular waveguide section 10 has a rectangular end wall 16 and the circular waveguide section 12 has a circular end wall 18, through which such screws can be attached. The two end walls have apertures 20 and 22, respectively, which are in register, for the passage of a portion 24 of a transmission line 26, 28 between the two waveguide sections 10 and 12, respectively. A dielectric sleeve 30 in the aperture 20 of the rectangular end wall 16 provides insulation, impedance matching, and mechanical support for the transmission line section 24, which forms with the sleeve 30 and the end wall 16 a short section of coaxial line. The transmission line section 28 within the circular waveguide 12 is a post, the free end of which is connected directly to the waveguide wall via a piece of rigid electrical conductor 32. A probe 34 extends from the free end of the post 28 radially inward toward the axis 36 of the circular waveguide 12. A second similar post 38 connected at one end to a section of coaxial line comprising an insulating sleeve 40 and a center conductor 44 is provided within the circular waveguide 12. The second post 38 is connected at its free end to a wall at the waveguide through a rigid section of electrical conductor 42, and has a probe 46 extending from it radially and with it toward the axis 36. The two probes are oriented ninety degrees apart as is best seen in FIG. 2.

The posts 28 and 38 are both off the axis of the circular waveguide 12, and support their probes from regions near the wall of the waveguide, oriented or pointed toward the axis 36. If radio frequency energy of the correct frequency is received in the circular waveguide 12 in the $TE_{11}$ mode, depending upon its polarization one or the other of the two probes will respond more strongly to it. If the probes are oriented to respond respectively to horizontally and vertically polarized received energy then each will respond to the energy for which it is oriented, substantially to the exclusion of the other energy. Each probe will couple the energy to which it responds to the coaxial line section through which it is connected to a companion probe 26 or 48, respectively, within the rectangular waveguide section 10.

Figure 4:
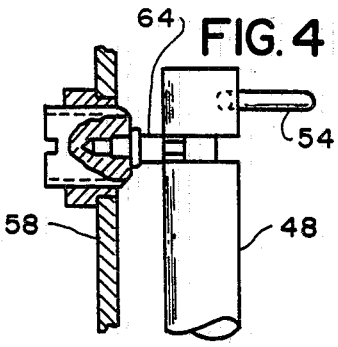
FIG. 4 is a fragmentary section taken on line 4—4 of FIG. 3.

The coupling structure of the network within the rectangular waveguide comprises a post 26 and 48, each closely adjacent a respective wide wall 56, 58 of the rectangular waveguide 10 and a probe 52 or 54, respectively extending from near the free end of each post toward the opposite wide wall of the waveguide. As is seen in FIG. 3 the probes 52 and 54 may be parallel to each other but they extend in opposite directions, and each at an angle other than normal to the wide walls. Each probe is connected from a point near its free end to the adjacent wide wall through a switch mechanism 62 or 64, respectively. In the embodiment illustrated, the switch mechanism is represented by a semiconductor diode of which switch 64 is shown in FIG. 4.

Figure 5:
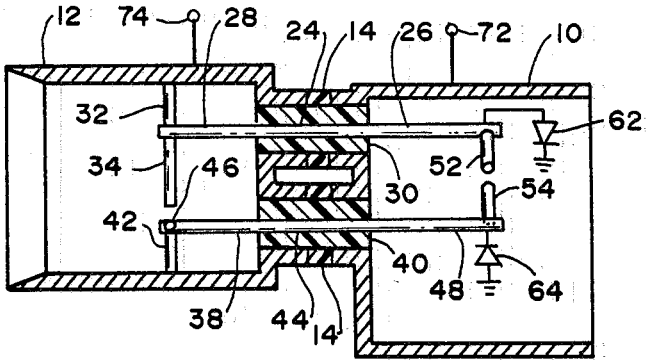
FIG. 5 is a simplified schematic of the device shown in FIG. 1.

Referring to FIG. 5, parts which correspond to parts in FIGS. 1 through 4 inclusive bear the same reference characters. FIG. 5 illustrates the structure of the bias circuits for switch diodes 62, 64 in relation to the mechanical structure of the device. As has been pointed out above, in the illustrated embodiment the outer shell of the rectangular waveguide 10 is insulated from the outer shell of the circular waveguide 12 by a dielectric 14 which is represented by a gap in FIG. 5. Bias terminals 72 and 74 are provided at the shells 10 and 12, respectively. The shell of the rectangular waveguide 10 may be considered to be ground.

Figure 6:
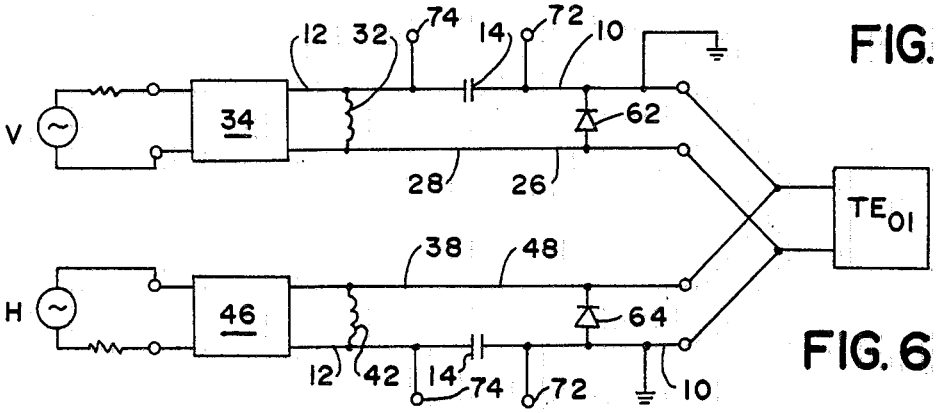
FIG. 6 is a simplified equivalent circuit of the device shown in FIG. 1.
Figure 7:
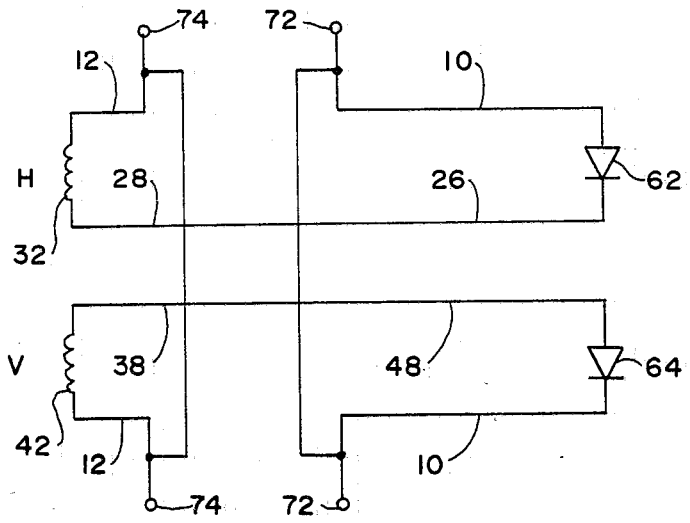
FIG. 7 illustrates a bias network for the device shown in FIG. 1.
Figure 8:
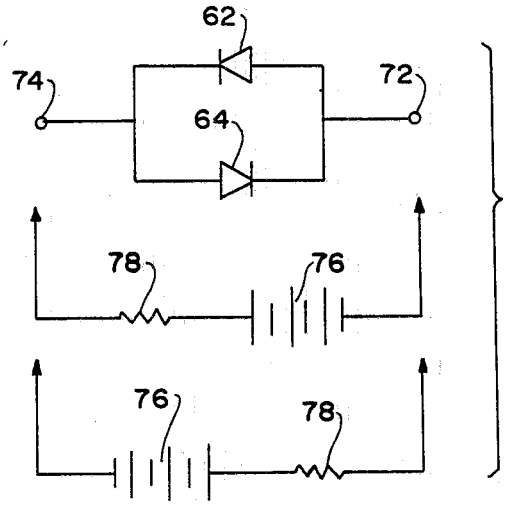
FIG. 8 is a simplified bias network.

FIG. 6 schematically represents the electrical circuit of the device shown in FIGS. 1–4. Blocks 34 and 46 represent the probes 34 and 46, which effect a conversion from circular waveguide to coaxial line. Inductors 32 and 42 represent the rigid conductive connections 32 and 42 in FIG. 1 or FIG. 5. Capacitors 14 represent the gap 14 or dielectric 14 in FIGS. 5 and 1, respectively. For convenience the horizontal and vertical channels have been shown separately, and so there are duplications of the bias terminals 72 and 74, purely for the purposes of illustration. FIGS. 7 and 8 simplify the illuatration of the bias circuit, employing diodes as the switches 62 and 64.

As is seen in FIG. 7 each bias circuit comprises a loop from the inductor 32 around through the diode 62 in one case, and from the inductor 42 around through the diode 64 in the other case. As is seen in FIG. 8 a suitable D.C. power supply, such as a battery 76 in series with a resistor 78, can be connected in one or the other of two directions to the bias terminals 72 and 74. Depending on the direction in which the power supply is connected, one of the diodes 62 or 64 will be rendered conductive while the other is rendered not conductive. If desired, a small negative bias can be applied to the diode which is to be rendered not conductive.

Referring now to FIGS. 5 and 6 the diode 62 or 64 which is rendered conductive will effectively short out its probe 52 or 54, respectively. Thus, in forward bias a diode will shut off its channel whereas in zero or slightly reversed bias its channel will be allowed to pass a signal received in the circular waveguide section to the rectangular waveguide section. Preferably PIN diodes are suitable for use in this application. In the rectangular waveguide section 10, the orientation of the diodes 62 and 64 is such that when one diode is open, the other diode is shorted out. The shorted probe (52 or 54) is reactive and is found to aid the impedance match in the active or open probe network thus providing minimum insertion loss between circular and rectangular waveguides in tne desired polarization.

When a switch is closed (i.e.: diode 62 or 64 is forward biased) the post 26 or 48, respectively to which it is connected is shorted to the wall of the rectangular waveguide 10. In that case, the relevant line loop 32, 28, 24, 30 and 26; or 42, 38, 40, 44 and 48; is a totally grounded loop and no RF current can pass through it. While the invention as illustrated employs one switch at each post within the rectangular waveguide 10, it will be understood that switches can be employed in place of the conductors 32 and 42 in addition to the switches 62 and 64, respectively or in place thereof. Electrical circuit variation employing four switches or altering the position of two switches, while not specifically described and illustrated, are within the scope of the invention. D.C. isolation provided by the dielectric 14 may be omitted and replaced by D.C. isolation between a diode and the wall of the adjacent waveguide if desired. Also, while switches in the form of semi-conductor diodes have been described and illustrated, it will be understood that mechanical switches appropriate for switching radio frequency energy at the frequencies employed may also be used.

If one of the probes 52 and 54 in the rectangular waveguide 10 is shorted by the corresponding diode or other means the other will launch the $TE_{01}$ mode in the rectangular waveguide while the shorted probe will be a reactive post with respect to that mode. The reverse situation is of course true. However, if both probes are fed simultaneously (both diodes are open) each will launch the $TE_{01}$ mode and in that case the network in the rectangular waveguide section will function as a combiner for the energy coming via both the input probes 34 and 46. The network in the rectangular waveguide then has two input ports and one output port. This configuration can be visualized from FIG. 6, where the diodes 62 and 64 are connected respectively across the input ports. Viewed from the coaxial line segments, 30, 24, and 44, 40 this network may be deemed to have two coaxial inputs and one $TE_{01}$ rectangular waveguide output port.

If neither diode 62, 64 is forward biased, signals can pass freely between each coaxial port and the waveguide port; by proper adjustment of the probe parameters the device then can become a matched power divider or combiner. If the device of FIG. 1 is operated in the above manner (neither diode shorted) then both vertical and horizontal signals in the circular waveguide will be transmitted to the rectangular waveguide. In addition, if a ninety degree phase shifter section is added in one of the coaxial lines, then a circularly polarized signal in the circular waveguide 12 will be transmitted to the rectangular waveguide 10, with no loss.

Figure 10:
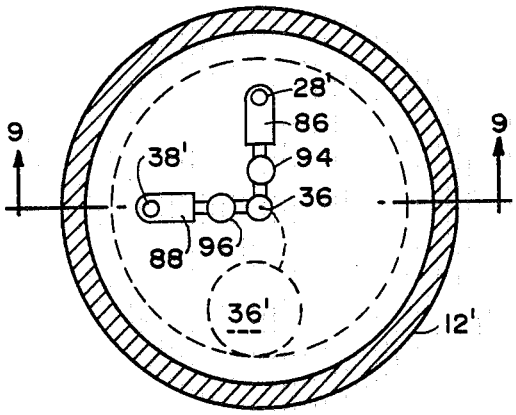
FIG. 10 is a transverse section on line 10—10 of FIG. 9.
Figure 9:
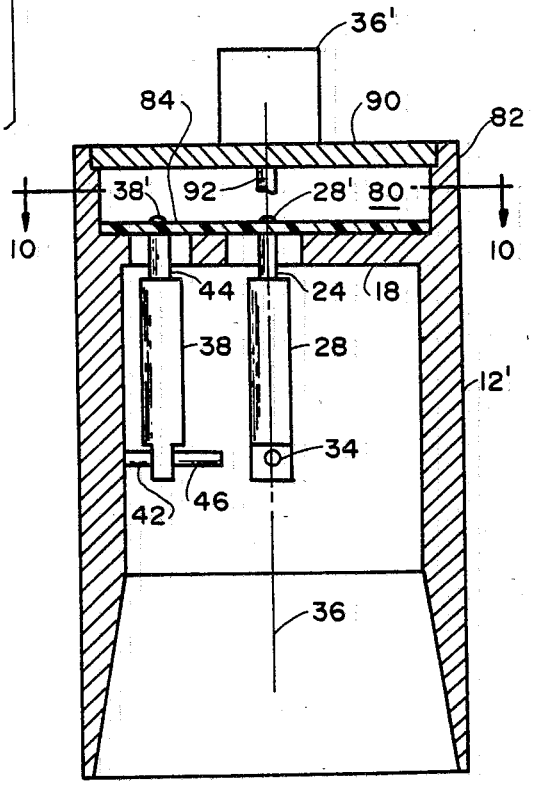
FIG. 9 shows another embodiment of the invention.

Referring to FIGS. 9 and 10, a section of circular waveguide 12', similar to the circular waveguide section 12 in FIG. 1, contains within it a pair of waveguide-to-coax transitions which include, respectively; a post 28, conductor 32 (as in FIG. 2), line section 24, and probe 34; and a post 38, conductor 42, line section 44, and probe 46; which are similar to the parts bearing the same reference characters in FIGS. 1 and 2. A recess 80 formed by circular waveguide wall 82 extending beyond the transverse circular end wall 18 houses a dielectric base 84, for microstrip conductors 86 and 88. A cover 90 for the recess 80 supports a coaxial output terminal 36' with its center conductor 92 extending inside the recess, conveniently on the circular waveguide axis 36. Posts 28 and 38 are connected via line sections 24 and 44, respectively, to one end each of the microstrip conductors 86 and 88, respectively, being fastened to those conductors at 28' and 38', respectively. Each microstrip conductor has a switch 94, 96 respectively, in it, and is connected through its switch to the central conductor 92 of the output terminal 36'. The switches 94, 96 may be diodes, similar to the diodes 62, 64 shown in FIGS. 1–4, or they may be switches in any other form suitable for switching in the microwave frequency ranges employed. Through the switches 94, 96 each transition may be enabled or disabled, as in the embodiment of FIGS. 1–4, and thereby, optionally, horizontally or vertically polarized signals may be fed to the single output terminal 36'. If desired, an amplifier may be located in the recess 80, to aid or to supplant the low noise amplifier component in a TVRO reception system, for example.

It is clear that the invention is not limited to the specific structures and uses that have been described and illustrated in the foregoing specification.

I claim:

1. A microwave transition device for receiving selectively one of a series of radio signals each of which is polarized in one or the other of two rectangularly related directions, comprising a primary waveguide for acquiring said signals polarized in both directions, first and second waveguide to coax transitions within said primary waveguide for selectively responding one to each of said polarizations, a secondary waveguide, first and second coax to waveguide transitions within said secondary waveguide, each capable of launching the basic mode microwave energy in said secondary waveguide, first and second path means to couple said first and second waveguide to coax transitions to said first and second coax to waveguide transitions, respectively, and switch means for selectively enabling and disabing each of said path means.

2. A transition device according to claim 1 in which each of said switch means is a solid state electronic device capable of being voltage biased between a substantially conducting state and a substantially non-conducting state, and including connections on the outside of said waveguides for applying bias voltage to each of said solid-state devices.

3. A microwave frequency network for coupling one or more of a series of radio signals, each of which is polarized in one or the other of two rectangularly related directions, in a single waveguide comprising a rectangular waveguide having within it a pair of line conductors each extending from one end parallel to but off-set from the longitudinal axis of said rectangular waveguide to a separate probe conductor which extends from a wide wall of said rectangular waveguide at an angle other than perpendicular thereto transversely to said longitudinal axis for coupling with or exciting the $TE_{O1}$ mode of microwave propagation, and switch means for selectively shorting each said line conductors to said waveguide.

4. A network according to claim 3 in which a pair of coaxial connectors are fitted to said waveguide, one for each of said line conductors, and said line conductors are connected, respectively, one to the center conductor of each of said coaxial connectors.

5. A network according to claim 3 in which each of said switch means is a solid state electronic device capable of being voltage biased between a substantially conducting state and a substantially non-conducting state, and including connections for applying bias voltage to each of said solid-state devices.

6. A microwave frequency network for coupling one or more of a series of radio signals, each of which is polarized in one or the other of two rectangularly related directions, in a single waveguide, comprising a length of waveguide having within it a pair of line conductors each extending approximately from one end of said section parallel to but off-set from the longitudinal axis of said waveguide section to a separate probe conductor which extends from a wall of said waveguide section transversely to said axis toward the interior of said waveguide section, for coupling with or exciting the basic mode of waveguide propagation of said waveguide section, coaxial output terminal means, means for providing an electrically conductive path from each of said line conductors to said output terminal means, and switch means for selectively enabling and disabling each individual loop comprised of one of said line conductors and one of said probe conductors.

7. A network according to claim 6 in which said waveguide is circular cylindrical and each of said probe means is a conductor extending radially inward from the waveguide wall in a direction so as to couple with or to excite a dominant $TE_{11}$ mode of microwave propagation polarized in only one or the other of said directions.

8. A network according to claim 7 in which said line conductors for each of said probe means is parallel to but off-set from the axis of said circular waveguide.

9. A network according to claim 6 in which said electrically conductive paths are microstrip conductors supported on a dielectric substrate fixed to said waveguide.

10. A network according to claim 6 in whih each of said switch means is a solid state electronic device capable of being voltage biased between a substantially conducting state and a substantially non-conducting state, and including connections for applying bias voltage to each of said solid state devices.

11. A network according to claim 6 in which said output terminal means is a single coaxial connector and each of said paths is connected at one end to the center conductor of said connector.

12. A microwave frequency network for coupling one or more of a series of radio signals, each of which is polarized in one or the other of two rectangularly related directions, in a waveguide means, comprising a length of waveguide having a longitudinal axis, a pair of separate probe conductors which each extend from a wall of said waveguide transversely to said longitudinal axis toward the interior of said waveguide, for coupling with or exciting the basic mode of waveguide propagation of said waveguide, switch means, a pair of line conductors each extending between a probe conductor and switch of said switch means, said switch means for selectively enabling and disabling each individual loop comprised of one of said line conductors and one of said probe conductors, output terminal means, and means for providing an electrically conductive path from each of said line conductors to said output terminal means.

13. A microwave frequency network as set forth in claim 12 in which each of said switches is a solid state electronic device capable of being voltage biased between a substantially conducting state and a substantially non-conducting state.

14. A microwave frequency network as set forth in claim 12 wherein the line conductors each include at least a section thereof that extends parallel to but offset from the longitudinal axis of said waveguide.

15. A microwave frequency network as set forth in claim 12 in which said waveguide is circular cylindrical and each of said probe conductors is a conductor extending radially inward from the waveguide wall in a direction so as to couple with or to excite a dominant $TE_{11}$ mode of microwave propagation polarized in only one or the other of said directions.

16. A microwave frequency network as set forth in claim 15 in which said line conductors for each of said probe conductors is at least partially parallel to but offset from the axis of said circular waveguide.

17. A microwave frequency network as set forth in claim 12 in which said electrically conductive paths are microstrip conductors supported on a dielectric substrate fixed to said waveguide.

18. A microwave frequency network as set forth in claim 12 in which said output terminal means is a single coaxial connector and each of said paths is connected at one end to the center conductor of said connector.

* * * * *